United States Patent [19]

Bagwell

[11] Patent Number: 4,878,256

[45] Date of Patent: Nov. 7, 1989

[54] SINGLE HANDLE DUAL FLUSHING TOILET

[76] Inventor: J. Jewell Bagwell, 103 Hicks Rd., Greenville, S.C. 29605

[21] Appl. No.: 77,882

[22] Filed: Jul. 27, 1987

[51] Int. Cl.[4] ..... E03D 1/14

[52] U.S. Cl. ..... 4/326

[58] Field of Search ..... 4/326, 327

[56] References Cited

U.S. PATENT DOCUMENTS 1,960,864 5/1934 Brown ..... 4/326

4,056,856 11/1977 Reid et al. ..... 4/326

4,175,295 11/1979 Cameron ..... 4/327

4,504,984 3/1985 Burns ..... 4/326

*Primary Examiner*—Charles E. Phillips

*Attorney, Agent, or Firm*—Bailey & Hardaway

[57] ABSTRACT

A toilet with a single handle can produce both light and heavy flushes as needed to conserve water. The handle can be lifted to produce one flush and depressed to produce the other. Separate levers attached to separated flush valves at different water levels are activated by the motion of the handle.

5 Claims, 4 Drawing Sheets

SINGLE HANDLE DUAL FLUSHING TOILET

BACKGROUND OF THE INVENTION

This invention relates generally to the art of toilet flush systems and more particularly to dual-flush valve systems of the type through which two different flush volumes of water may be released in order to evacuate a toilet bowl. In an effort to conserve water many varible toilet flush systems have been developed, but very few have required only one handle for such flushes.

One such single handle for dual flushes is disclosed in U.S. Pat. No. 4,504,984. This patent discloses a single flush lever attached to two flush valves. A partial or full flush is effectuated by a partial or full depression of the handle, thus requiring the user to regulate the manual force he applies to the handle.

U.S. Pat. No. 4,175,295 describes a system whereby the user has the option of either rotating the handle in one direction for a light flush or the opposite direction for a heavy flush. But the positioning of a single internal lever is biased by a pair of springs which are subject to wear and stretching.

Other single handle, dual-flushing systems have been proven to be functionally unreliable and to require of the user a non-traditional means of flushing.

SUMMARY OF THE INVENTION

It is thus an object of this to provide a single handle, dual-flushing toilet.

It is a further object of this invention to provide a single handle, dual-flushing toilet with functional certainty based on the traditional flushing mechanism of each single flush lever attached to a single flush valve.

It is a still further and more particular object of this invention to provide a single handle, dual-flushing toilet with a first lever inside the tank to effectuate a full flush, a second lever inside the tank to effectuate a partial flush and a means by which the first lever acts on the second lever.

DETAILED DESCRIPTION

In accordance with this invention it has been found that a single handle of a toilet can be depressed to cause one flush lever to rise and can be lifted to cause a second flush lever to rise. These two levers are connected to separate flush valves located at different water levels within the toilet tank. Thus, lifting the handle causes a flush of one degree and depressing the handle causes a flush of another degree. Various advantages and features will be apparent from the following description given with reference to the various figures of the drawings.

Figure 1:
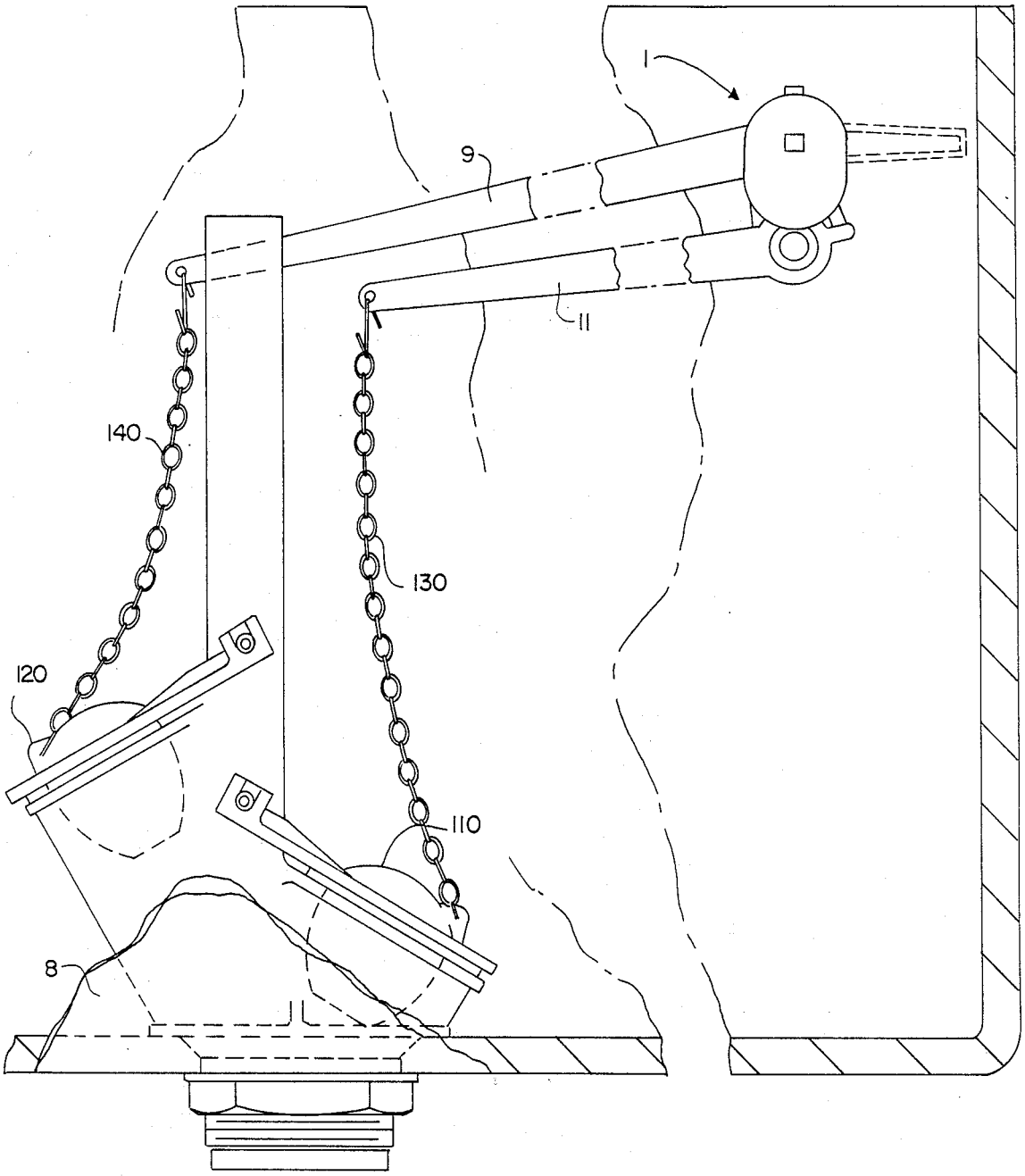
FIG. 1 of the drawings is a cross section view of the tank in accordance with this invention.

FIG. 1 illustrates a flush mechanism 1 in accordance with this invention. Flush valve 110 is located on the bottom of the tank while flush valve 120 is at a higher water level. Lever mechanism 1 is connected to valves 110 and 120. In the preferred embodiment, chain 130 connects lower flush valve 110 to lower lever 11 and chain 140 connects upper flush valve 120 to upper lever 9. Thus, the raising of lower lever 11 results in a full flush; while the raising of upper lever 9 results in a partial flush.

Figure 2:
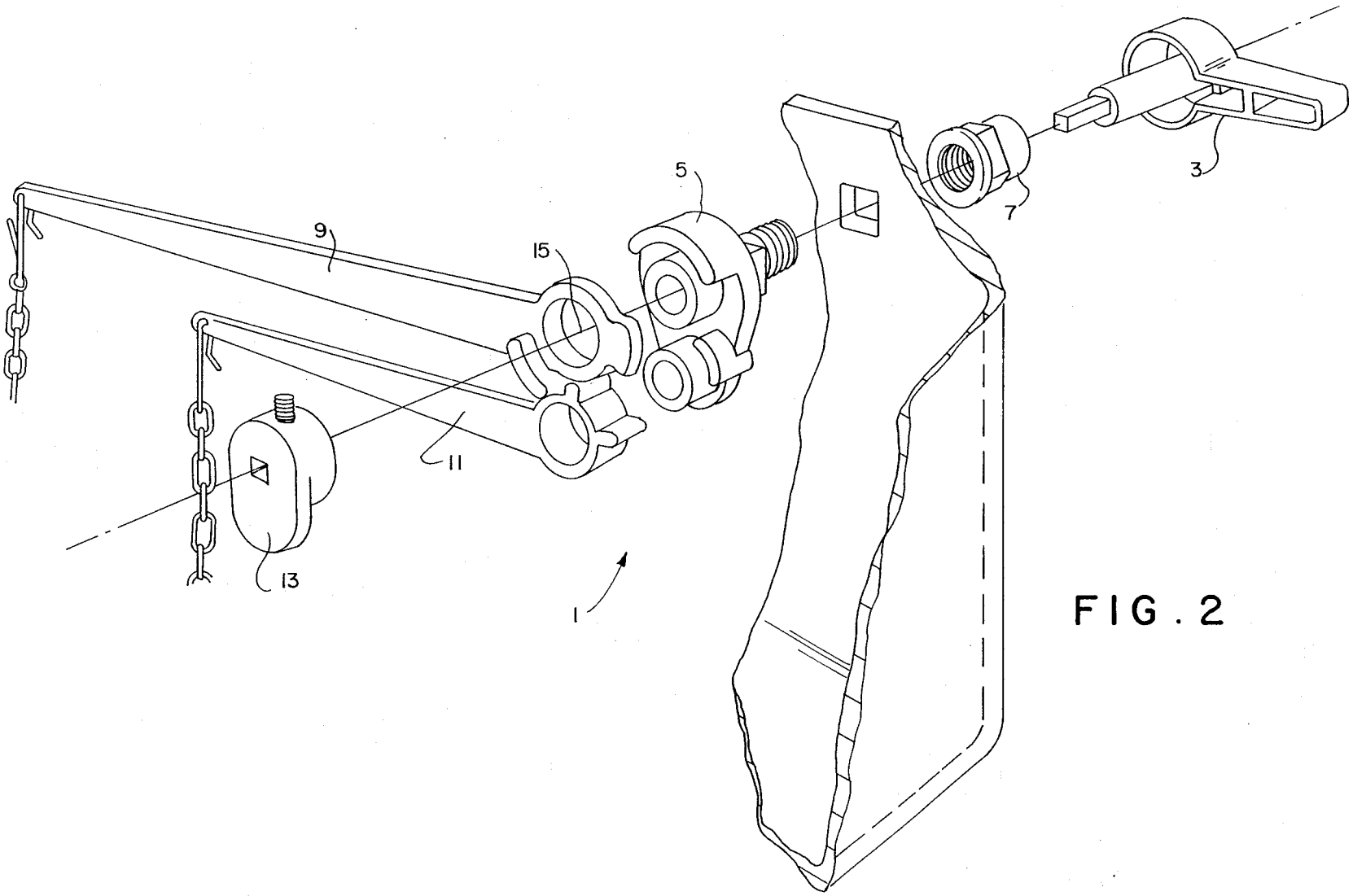
FIG. 2 of the drawings is a perspective view illustrating the handle and lever mechanisms of this invention.
Figure 3:
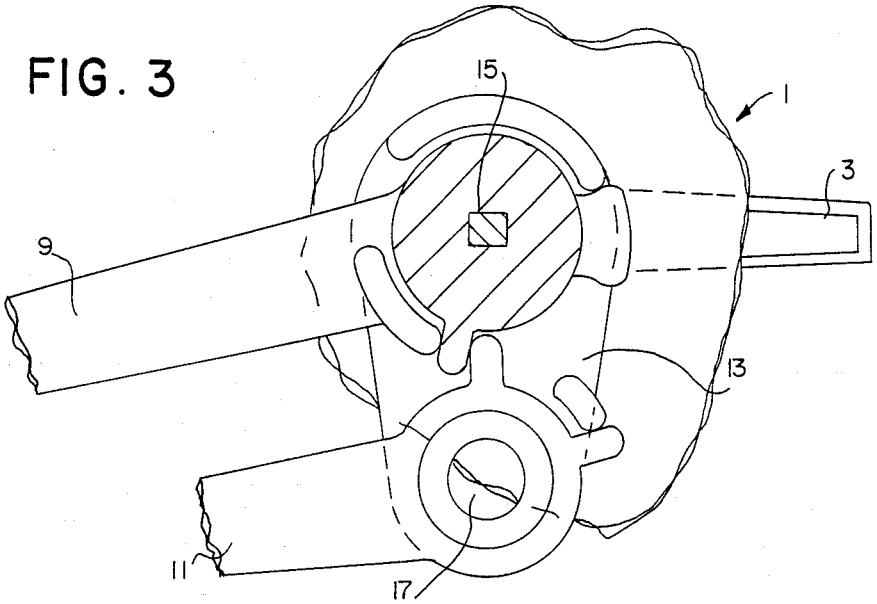
FIG. 3 of the drawings is a breakaway view of the interaction between the levers in this invention.

The operation of each lever 9 and 11 is best understood by reviewing the handle and lever mechanism 1 of this invention as shown in FIG. 2. A handle 3 is held to a pivot stator 5 by retaining nut 7. An upper lever 9 and a pivot stator 5 by a retaining nut 7. An upper lever 9 and a lower lever 11 fit onto the pivot stator 5 as shown. An actuator 13 fits into the upper lever 9 at its pivot point 15. This is best illustrated in FIG. 3, which shows the handle and lever mechanism 1 in the resting position. The actuator 13 covers both the pivot point 15 of the upper lever 9 and the pivot point 17 of of the lower lever 11.

Figure 4:
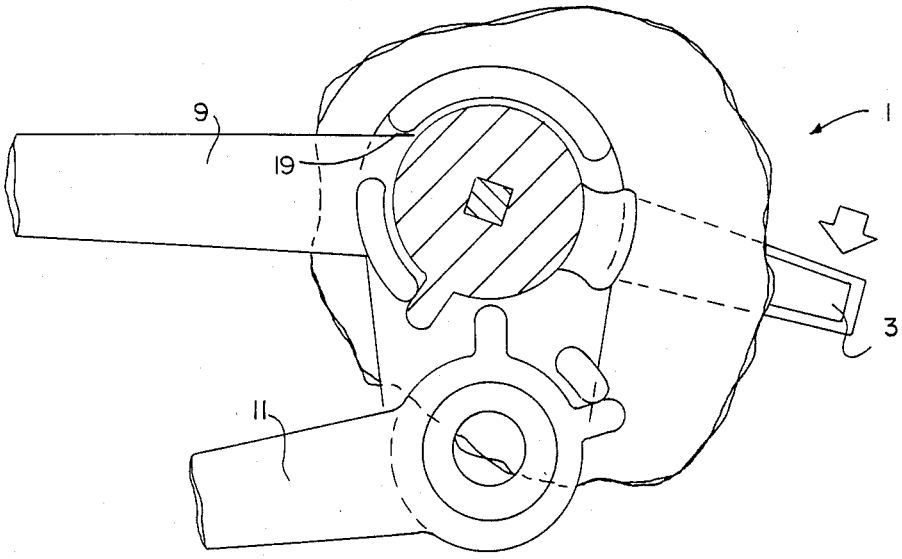
FIG. 4 of the drawings is a view similar to FIG. 2 in a different mode of operation.

FIG. 4 illustrates the handle and lever mechanism 1 with the handle 3 depressed. The upper lever 9 rises until it hits its "up" stop 19. The lower lever 11 is unaffected.

Figure 5:
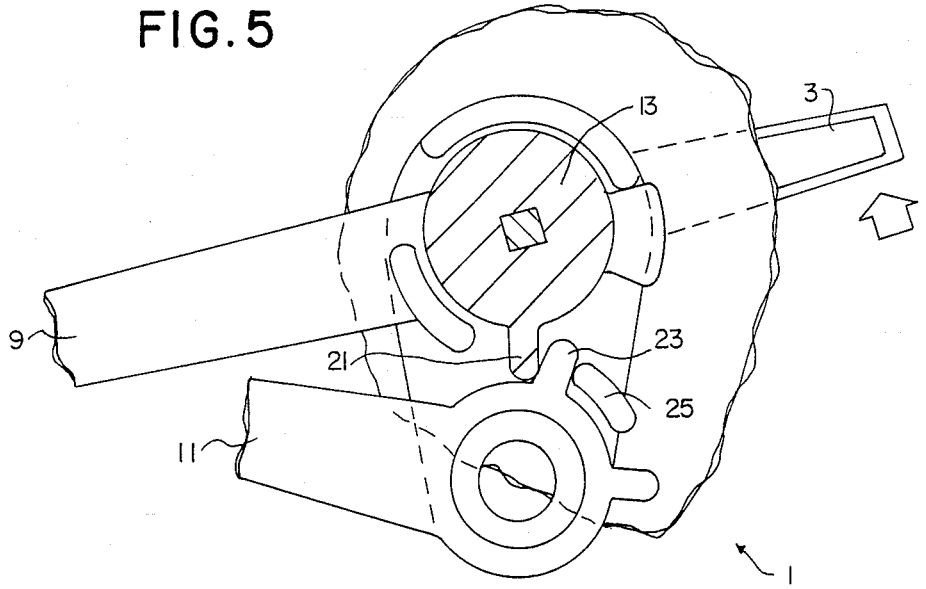
FIG. 5 of the drawings is a view similar to FIG. 3 and FIG. 4 in a different mode of operation.

FIG. 5 illustrates the means by which a lifting of the handle 3 causes the rising of the lower lever 11. Lifting handle 3 lowers the upper lever 9 and rotates the actuator 13. A gear tooth 21 on the actuator moves against a gear tooth 23 on the lower lever 11 until the lower lever 11 hits its "up" stop 25.

Thus a depression of the handle causes the upper lever to rise. This upper lever is attached to a flush valve at one of two different water levels. A lifting of the handle causes the lower lever to rise. This lower lever is attached to the other valve. Either partial or full flush can be effectuated by depressing of lifting the handle depending on which lever is attached to which valve. In the preferred variation the upper lever is attached to the valve at a higher water level and the lower lever is attached to the valve at a lower water level. Thus, depression of the handle, the more traditional of the two flushing means effectuates a light flush and conserves water. Lifting of the handle effectuates a full flush.

It is apparent that the invention disclosed herein provides a means for effectuating a light or heavy flush of a toilet by either lifting or depressing the handle. As many variations will be apparent from a reading of the above description, such variations are embodied within the spirit and scope of this invention as defined by the following appended claims.

What is claimed is:

1. In a toilet having a tank, a source of water into the tank, and two independent control valves at different water levels within the tank for effectuating both light and heavy flushes, the improvement comprising:

a single handle on the outside of said tank in communication with said independent control valves through a first pivot axis extending through said tank;

a first lever inside said tank connected to said handle about said first pivot, axis a first lever inside of said tank which rises when said handle is depressed for movement about said axis in one direction, said lever being lowered when said handle is lifted for movement about said pivot axis in an opposite direction;

a second lever in communication with said first lever said second lever having a pivot axis different from said first lever said second lever rises when the first lever is lowered upon raising said handle;

a gear tooth on said second lever;

actuator means mounted about said first pivot axis of said first lever, means for connecting each of the levers to a respective one of the two independent control valves;

said actuator means having a gear tooth for engaging said gear tooth of said second lever and causing said second lever to pivot about said different axis and whereby the raising of each lever effectuates a different flush allowing for water conservation.

2. The improvement set forth in claim 1 wherein a drop of the first lever causes the gear tooth on the actuator to move against the gear tooth on the second lever so as to make said second lever rise.

3. The improvement set forth in claim 1 wherein one lever is attached to the control valve at a lower water level and the other lever is attached to the control valve at a higher water level.

4. The improvements set forth in claim 3 where the first lever is attached to the control valve at a higher water level and the second lever is attached to the control valve at a lower water level;

whereby lifting the handle effectuates a heavy flush and depressing the handle effectuates a light flush allowing for water conservation whenever possible.

5. The improvement set forth in claim 4 wherein the second lever is shorter than the first.

* * * * *